United States Patent [19]

Millard

[11] 4,011,905

[45] Mar. 15, 1977

[54] HEAT EXCHANGERS WITH INTEGRAL SURGE TANKS

[75] Inventor: Gregory Stephen Truscott Millard, Brampton, Canada

[73] Assignee: Borg-Warner Corporation, Chicago, Ill.

[22] Filed: Dec. 18, 1975

[21] Appl. No.: 641,807

[52] U.S. Cl. ..... 165/175; 123/41.27; 123/41.54; 165/41; 165/153

[51] Int. Cl.[2] ..... F28D 9/00; F28F 3/08; F28F 9/22; F01P 3/22

[58] Field of Search ..... 123/41.54, 41.27; 165/41, 151, 152, 153, 165, 166, 167, 175

[56] References Cited

UNITED STATES PATENTS

| | | | |
|---|---|---|---|
| 1,630,069 | 5/1927 | Muir | 123/41.54 |
| 3,077,927 | 2/1963 | White et al. | 123/41.27 |
| 3,258,832 | 5/1966 | Gerstung | 29/157.3 |
| 3,310,869 | 3/1967 | Porte et al. | 29/157.3 |
| 3,341,925 | 9/1967 | Gerstung | 29/157.3 |
| 3,604,502 | 9/1971 | Morse et al. | 123/41.27 |
| 3,623,462 | 11/1971 | Anders et al. | 123/41.27 |
| 3,702,021 | 11/1972 | Wolfe et al. | 29/157.3 |
| R26,550 | 3/1969 | Beatenbough et al. | 123/41.54 |

FOREIGN PATENTS OR APPLICATIONS

| | | | |
|---|---|---|---|
| 1,264,130 | 2/1972 | United Kingdom | 123/41.54 |

*Primary Examiner*—Albert W. Davis, Jr.
*Assistant Examiner*—Sheldon Richter
*Attorney, Agent, or Firm*—James A. Geppert

[57] ABSTRACT

A stacked plate or plate-fin separator type of heat exchanger wherein each plate has an integral extension at one end including an aperture which, when stacked with other plates, forms a chamber separate from but positioned at one end of the heat exchanger. The chamber is interconnected through the bottom plate and/or top plate with the fluid flow in the heat exchanger to provide a surge tank having an air space formed during operation to compensate for volume changes of both the heat exchanger and the fluid therein and also to deaerate the core under vehicle operating conditions.

20 Claims, 9 Drawing Figures

45
46
47
48
49
51
52
53
54
55
56
57
58
59
60
61
62
63
64
65
66
67
68
69
9

HEAT EXCHANGERS WITH INTEGRAL SURGE TANKS

BACKGROUND AND SUMMARY OF THE INVENTION

Heat exchangers or radiators of the cross-flow variety are generally formed from a plurality of relatively flat heat exchange plates, each plate having an inlet port at one end and an outlet port at the opposite end joined by a fluid passage or conduit having turbulizer means therein to break up and distribute the fluid flow over the heat exchange surfaces; while a second fluid, such as air passes between the plates in a direction perpendicular to the direction of fluid flow within the plates. Also, a heat exchange plate may be of the multipass type where both the inlet and outlet ports are located at the same end of the plate.

The individual plates are stacked together with the inlets and outlets aligned and are brazed or otherwise sealed together in fluid-tight relation. The top and bottom plates have normally imperforate outer surfaces, except for the inlet and outlet ports, to close the heat exchanger, and suitable fittings are secured to the inlet port and outlet port at the upper and/or lower ends of the stack for attachment to suitable lines communicating with the fluid to be cooled. If, for any reason, a surge tank is required for the heat exchanger or radiator, it is generally isolated therefrom and connected through an externally positioned connection between the heat exchanger core and the tank.

With the advert of higher operating temperatures and pressures of modern automotive cooling systems, especially due to the addition of pollution control equipment on automotive engines requiring higher operating temperatures, a surge or overflow tank is virtually a necessity for proper operation of the cooling system. The present invention, therefore, relates to the use of a surge tank with a heat exchanger or radiator of the cross-flow type, and more particularly to a heat exchanger or radiator having an integral surge tank.

The present invention comprehends the provision of a novel heat exchanger, radiator or evaporator having an integral surge tank to compensate for the volume changes, as a result of temperature variation, of both the heat exchanger and the fluid therein and provide deaeration of the fluid during vehicle operation, including afterboil. This is accomplished by providing a surge tank with a retained air space therein which is not used for heat transfer. As a result, the heat exchanger remains full of fluid at all times which, in turn, increases the efficiency of the heat exchanger.

The present invention also comprehends the provision of a novel stacked plate heat exchanger or a radiator or evaporator of the plate-fin separator variety which has an integral surge tank formed at one end of the assembly. While a stacked plate heat exchanger or plate-fin separator radiator or evaporator normally consists of a plurality of elongated plates connected at their ends to provide aligned inlet and outlet ports forming an inlet passage and an outlet passage connected by a series of fluid passages formed in the plates; the surge tank of the present invention is formed integral with the stacked plates, located beyond one end of the flow passages and connected to the adjacent passage through an embossment formed in the bottom plate of the stack.

The present invention further comprehends the provision of a novel heat exchanger, radiator or evaporator having an integral surge tank that does not require any additional forming or assembly steps other than those required to produce the heat exchanger. This design not only eliminates the manufacturing labor involved in making a surge tank, but also eliminates the mounting and plumbing to a radiator that are required by conventional designs.

Further objects are to provide a construction of maximum simplicity, efficiency, economy and ease of assembly and operation, and such further objects, advantages and capabilities as will later more fully appear and are inherently possessed thereby.

DESCRIPTION OF THE PREFERRED EMBODIMENTS

Figure 1:
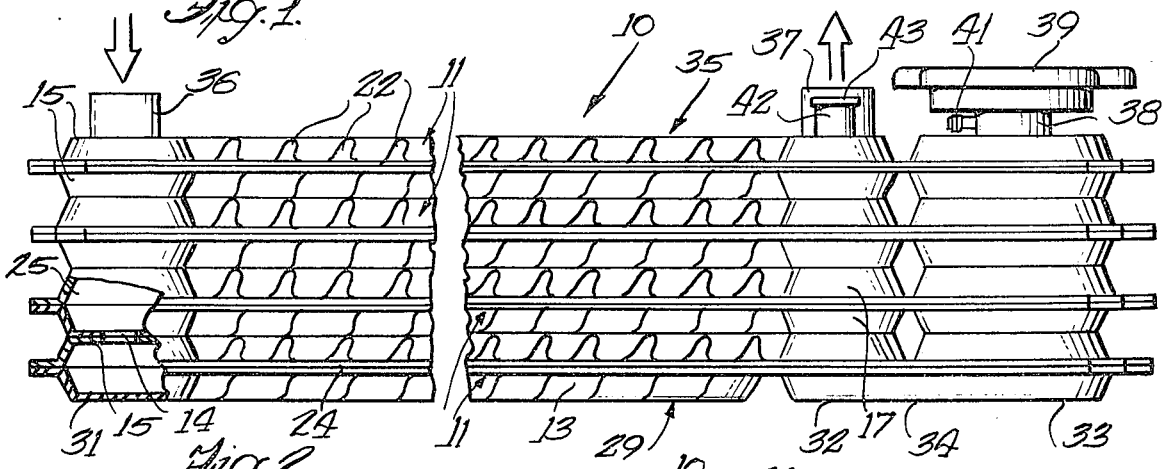
FIG. 1 is a front elevational view of a heat exchanger of the stacked plate variety having an integral surge tank.

Referring more particularly to the disclosure in the drawings wherein are shown illustrative embodiments of the present invention, FIG. 1 discloses a heat exchanger 10 of the stacked plate type adapted to provide for a single pass or multipass operation and formed by a plurality of heat exchanger plates 11 of a metal having high heat conductivity, such as aluminum. Each heat exchanger plate 11 is formed of a pair of oppositely disposed dished plate members 12, each member 12 having a heat exchange portion 13 including an inlet opening or port 14 defined by a raised flange 15 and an outlet opening or port 16 defined by a second raised flange 17; and an extension or extending portion 18 beyond the portion 13 includes an enlarged opening or aperture 19 defined by a third raised flange 21. Formed on each plate member 12 between the openings 14 and 16 are a plurality of spaced parallel ridges or ribs 22 formed at an acute angle to the longitudinal axis of the plate; the ridges 22 being identically arranged and positioned on each plate member 12 as formed.

The sheet metal members 12 are formed by stamping such that all of the ridges 22 and flanges 15, 17 and 21 extend from one side of the flat sheet, with the ridges and flanges being of substantially the same height. Also, as the ridges are pressed into the sheet metal, a corresponding groove 23 will be provided on the opposite side of the sheet. Each of the ridges 22 extends across a plate member 12 to terminate short of the peripheral edge 24 of the member; and one or more ridges 22′ intersect the raised flanges 15 and 17 so that one or more grooves 23′ will open into the space 25 or 26 formed by the flange 15 or 17, respectively.

Figure 2:
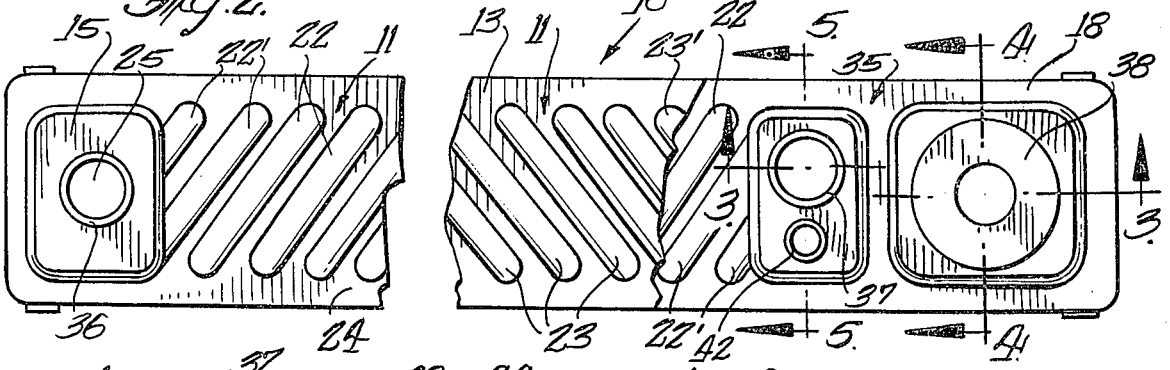
FIG. 2 is a top plan view of the heat exchanger of FIG. 1 with portions broken away.
Figure 3:
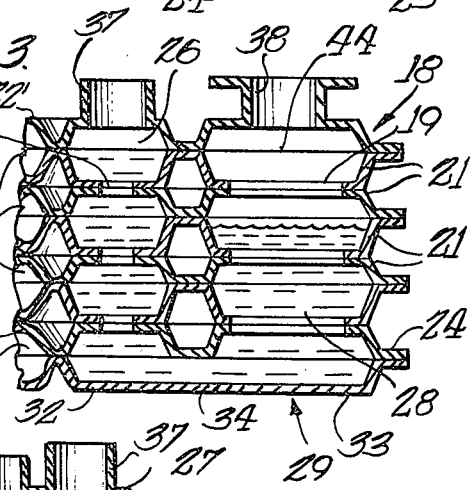
FIG. 3 is a vertical cross sectional view taken on the irregular line 3—3 of FIG. 2.
Figure 4:
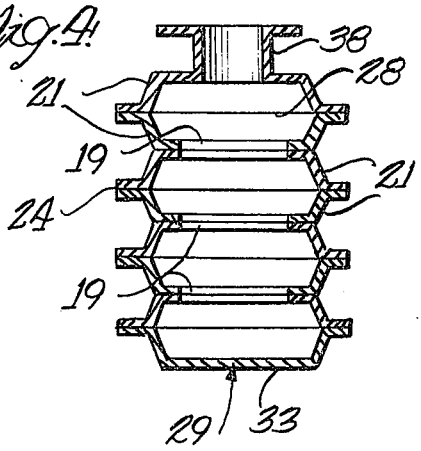
FIG. 4 is a vertical cross sectional view taken on the line 4—4 of FIG. 2.
Figure 5:
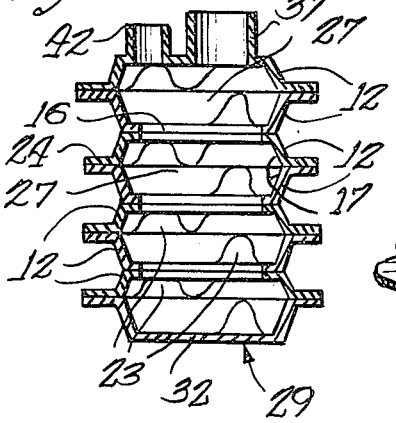
FIG. 5 is a vertical cross sectional view taken on the line 5—5 of FIG. 2.
Figure 6:
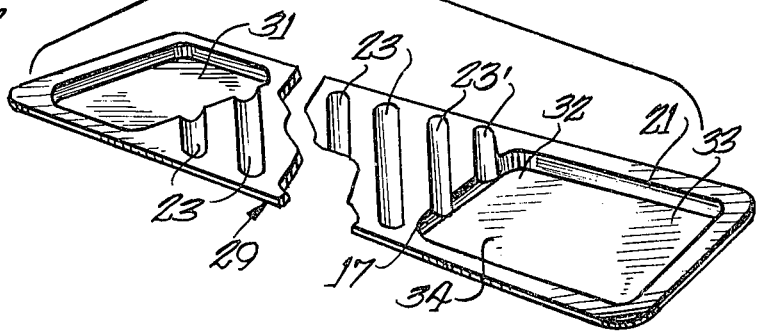
FIG. 6 is a perspective view of the bottom sheet of the stacked plates.

To form the stacked plate heat exchanger 10, one of a pair of sheet members 12 is flipped over so that the members are oppositely disposed and face each other with the peripheral edges 24, 24 abutting to enclose the fluid flow passage 27 formed therebetween. The grooves 23 of the plate members 12 face each other in each plate 11 with the grooves of one member extending over and intersecting the facing grooves of the adjacent member, as seen in FIG. 2, to provide a generally sinuous flow path for liquid passing through said plate 11 between the inlet opening 14 and the outlet opening 16. The individual plates are stacked together with the inlet openings 14, the outlet openings 16 and the enlarged openings 19 vertically aligned and clamped or secured together.

One method of formation of the heat exchanger is to form the plate members 12, 12 in a single connected sheet with elongated slots between the members and defining hinge straps adjacent the ends. Such a method of assembly is clearly shown in the Donaldson U.S. Pat. No. 3,211,118.

When asembled, both the ridges 22, 22′ and the raised flanges 15, 17 and 21 of adjacent plates 11 abut each other, with the ridges abutting at one or more cross-over points. Thus, the inlet openings 14 are aligned to provide a continuous inlet chamber 25, the aligned outlet openings form a continuous outlet chamber 26 and the enlarged openings 19 are aligned to form an enlarged chamber or surge tank 28. The sheet metal is preferably coated with a suitable brazing compound so that, upon heating, the contacting portions of metal will bond or fuse together to provide a unitary heat exchanger unit.

Figures 7, 8, 9:
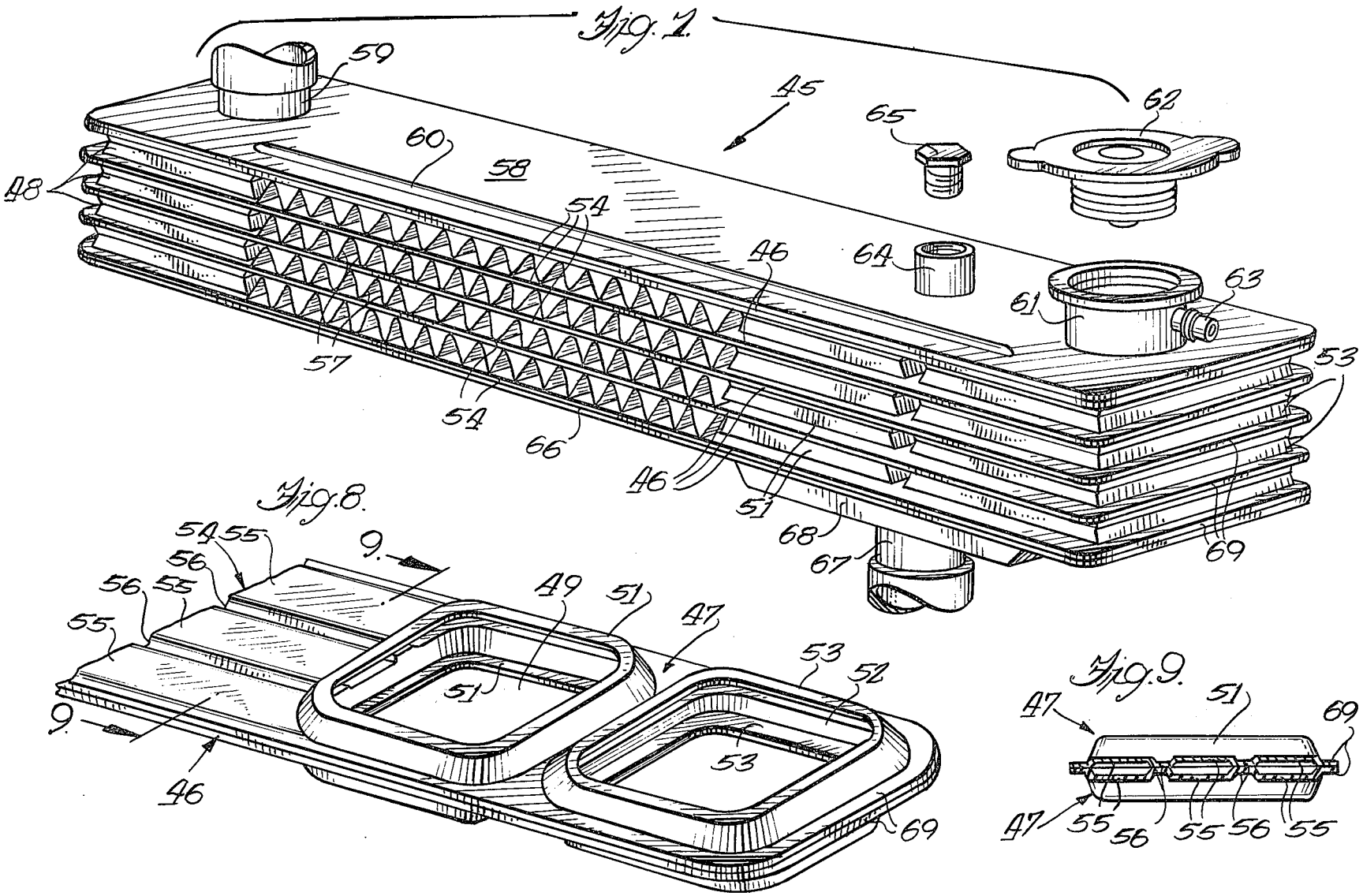
FIG. 7 is a perspective view of an alternate embodiment of heat exchanger in the form of a plate-fin separator radiator.
FIG. 8 is an enlarged perspective view of an end portion of a plate in the radiator.
FIG. 9 is a vertical cross sectional view taken on the line 9—9 of FIG. 8.

The bottom plate member 29 of the heat exchanger shown in FIG. 7 has the inlet, outlet and enlarged openings closed at 31, 32 and 33, respectively, and an embossment 34 is provided in the bottom plate member 29 to bridge between and allow fluid flow from the outlet closure 32 to the enlarged chamber 28 formed by the openings 19 and joined raised flanges 21. The top plate member 35 has fittings 36 and 37 connected to the flanges 15 and 17 communicating with the openings 14 and 16, respectively, to lead to a source of fluid to be treated and to a reservoir or other area for the treated fluid. Also, a filler neck 38 is secured to the flange 21 in the top plate member 34 to receive a pressure cap 39 thereon and has an overflow fitting 41 as is conventional for automobile radiators. An air vent fitting 42 receiving an air release plug 43 is also suitably located in the plate member 34 for a purpose to be later described.

The enlarged chamber 28 forms a surge tank integral with the heat exchanger 10 extending beyond the outlet openings 16 and communicating with the outlet chamber 26 through the embossment 34. To fill the system, the filler cap 39 and the air bleed-off screw or plug 43 are removed and the heat exchanger is filled with liquid, such as a coolant, so that the inlet manifold 25 and outlet manifold 26 as well as the core formed by passages 27 and the surge tank 28 are completely full of coolant. The pressure cap 39 and air bleed-off screw 43 are then replaced. On th first heating of the cooling system to which the heat exchanger 10 is attached, the coolant will expand resulting in an overflow of the coolant due to activation of the pressure cap 39. A volume of coolant less than the volume of the surge tank 28 (approximately ½ will be dumped through the overflow fitting 41. On cooling of the exchanger 10 and associated cooling system, the coolant will return to normal volume and air will be drawn in through the pressure cap 39 and fill a space 44 in the surge tank 28 approximately equal to one-half the volume of the surge tank; the air being at atmospheric pressure. This air space 44 will form a cushion to compensate for volume changes of both the heat exchanger and the coolant therein. From this time on, during the cyclic operation, the level in the surge tank 28 will fluctuate from approximately one-half full to completely full, with the heat exchanger 10 including inlet and outlet manifolds remaining full at all times.

Under normal operating conditions, fluid to be cooled enters the inlet fitting 36 and the inlet openings 14 and passes through the plates 11 via the sinuous path in the flow passages 27 formed by the intersecting grooves 23. Air or other cooling fluid passes through the heat exchanger between the plates 11 and between the ridges 22, 22′ to provide maximum heat transfer between the hot fluid and the air or other cooling fluid. The cooled fluid exits through the outlet openings 16 to the fitting 37 to return to an engine or other machine.

FIGS. 7 through 9 disclose an alternate embodiment of heat exchanger wherein the surge tank is utilized for a plate-fin separator type of radiator or evaporator 45. This radiator utilizes a plurality of horizontally arranged plates 46, each plate being formed of a pair of sheet metal dished members 47 (see FIGS. 8 and 9), each member having an inlet port formed by a raised flange 48, an outlet port 49 formed by a second raised flange 51 and a third opening 52 formed by a third raised flange 53. The inlet and oulet ports are connected by a core portion 54 formed by longitudinally extending raised tubular portions 55 divided by depressions 56, 56.

The tubular portions 55 are of considerably less height than the raised flanges 48, 51 and 53 so that when the plates 46 are assembled, the flanges of adjacent plates abut in sealed relation while the core portions 54 are spaced apart, as seen in FIG. 7, to provide elongated open spaces adapted to receive partially folded or corrugated heat exchange fins 57 arranged to contact the core portions and allow transverse flow of air through the spaces between the plates.

The uppermost plate of the radiator 45 has an upwardly opening sheet metal dished member 47 sandwiched with a substantially planar sheet member 58 having at one end an inlet fitting 59 secured therein aligned with the inlet ports and flanges 48, and at the opposite end a filler neck 61, for a pressure cap 62 and having an overflow fitting 63, aligned with the openings 52 and flanges 53. An air vent fitting 64 is aligned with the openings 49 and flanges 51 and receives an air release plug 65. Also, an elongated longitudinally extending ridge or bead 60 is formed in the plate 58 to provide a restricted channel therein communicating with the inlet port, the outlet port 49 and the third opening 52 forming the surge tank for a purpose to be later described.

The bottom plate is also formed with a downwardly opening sheet metal dished member 47 sandwiched with a generally planar sheet member 66 having an outlet fitting 67 aligned with the ports 49 and generally opposite the air vent fitting 64 in the planar member 58. An elongated embossment 68 is formed in the planar member 66 as a passage to connect the spacing formed by the flanges 51 with the spacing formed by the flanges 53; the outlet fitting 67 being positioned on the embossment 68. As noted in the previous embodiment, the plates are assembled and suitably joined together by brazing or soldering, so that the flanges 48 form an inlet chamber, the flanges 49 form an outlet chamber, and the flanges 53 form a surge tank; the plate members 47 for each plate 46 being oppositely disposed and joined along their peripheral edges 69. The filling and operation of this radiator or evaporator 45 is identical with that of the previous embodiment, with the exception that the inlet fitting 59 and outlet fitting 67 are diagonally opposite rather than both at the top of the heat exchanger.

As this embodiment is utilized as a radiator for an automobile engine wherein air is normally entrained with the coolant liquid during circulation through the system, the ridge 60 allows for the passage of air entrapped in the inlet chamber and/or the outlet chamber as the liquid passes therethrough. Any entrapped air in the inlet or outlet chambers passes through the restricted passage formed by the ridge in the top plate to accumulate in the surge tank and add to the air cushion therein. The ridge 60 will provide for deaeration during vehicle operation and for afterboil deaeration and insures that only air will escape through the radiator cap relief valve.

Thus, the present invention is suitable for automotive heat exchangers, radiators and evaporators, and for radiators for small recreational vehicles, such as all-terrain vehicles, snowmobiles, etc.

I claim:

1. A heat exchange plate comprising a heat exchange portion and an extended portion, said heat exchange portion having an inlet port, an outlet port and a core portion extending therebetween an defining a flow path between the ports, and a surge chamber formed in the extended portion and adapted to communicate with said flow path.

2. A heat exchanger comprising a plurality of plates, each of said plates having a heat exchange portion and an extended portion and being in at least partial contact with adjacent plates; said heat exchange portion having an inlet port, and outlet port, and a core portion extending therebetween; said core portion defining a flow path between the inlet and outlet ports; and a surge tank formed by said extended portion of said plates and communicating with said flow path.

3. A heat exchanger as set forth in claim 2, in which said surge tank comprises upper and lower raised flanges on each extended portion defining an enlarged opening therein, said flanges of adjacent plates being suitably joined together.

4. A cross-flow heat exchanger comprising a plurality of substantially identical plates for parallel flow paths, each plate having an inlet port, an outlet port and a core portion extending therebetween, said plates being formed of plate members arranged in face-to-face pairs joined at their peripheral edges and forming a flow path between the inlet and outlet ports, said plates being stacked with their ports in alignment, conduit means connecting said aligned inlet ports and aligned outlet ports, and surge tank means formed in said plates beyond one set of ports and communicating with said plates.

5. A heat exchanger as set forth in claim 4, in which said surge tank means comprises a raised flange on each side of each plate defining an enlarged opening therein, said flanges of adjacent plates being joined in sealing relation to form a surge tank.

6. A heat exchanger as set forth in claim 5, in which the surge tank portion formed by the raised flanges is sealed from the remainder of the plate.

7. A heat exchanger as set forth in claim 6, in which the bottom surface of the lowermost plate of the stack has the inlet, outlet and enlarged openings sealed, and the uppermost plate has the enlarged opening secured to a pressure cap fitting for the surge tank.

8. A heat exchanger as set forth in claim 7, wherein an embossment is formed in said lowermost plate member between said outlet port and said surge tank portion to provide communication between said plates and said surge tank.

9. A heat exchanger as set forth in claim 4, in which said conduit means includes a raised flange defining each inlet and outlet port and extending above and below each plate, said flanges of adjacent plates being in contact and suitably joined together to provide aligned inlet and outlet passages.

10. A heat exchanger as set forth in claim 9, in which each plate member includes a plurality of parallel ridges disposed at an acute angle to the longitudinal axis of the member, said ridges of a facing pair of members defining internal grooves forming a flow path between the inlet and outlet ports.

11. A heat exchanger as set forth in claim 10, in which said raised flanges and said ridges extend outwardly from the plates for substantially the same height, said ridges of adjacent plates being in contact and suitably joined at crossing points of said ridges.

12. A heat exchanger as set forth in claim 11, in which said grooves of a facing pair of plate members are oppositely oriented so as to intersect at a multiplicity of points and form a sinuous passage between the inlet port and outlet port.

13. A heat exchanger as set forth in claim 12, in which at least one groove intersects the raised flange defining an inlet port or an outlet port.

14. A heat exchanger as set forth in claim 13, in which said surge tank means includes a raised flange on each plate member defining an enlarged opening therein spaced from the outlet port, the last-mentioned flanges of adjacent plates being suitably secured together to form a surge tank.

15. A heat exchanger as set forth in claim 14, in which the surge tank is sealed from the remainder of the stack of plates.

16. A heat exchanger as set forth in claim 15, in which the lowermost plate member in the stack is imperforate and the uppermost plate member has a pressure cap fitting connected to the enlarged opening of the surge tank.

17. A heat exchanger as set forth in claim 16, including an embossment formed in the lowermost plate member between the raised flanges for the outlet opening and the enlarged opening to provide communication between said plates and said surge tank.

18. A heat exchanger as set forth in claim 9, wherein said core portions of said plates are spaced apart, and a plurality of fins are positioned between said core portions for air flow therethrough.

19. A heat exchanger as set forth in claim 18, in which said surge tank means includes a raised flange on each plate member defining an enlarged opening therein spaced from the outlet port, said last mentioned flanges being sealed together to form a surge tank isolated from the remainder of the plates, and an embossment formed in the lowermost plate between the outlet port and the surge tank to provide communication therebetween.

20. A heat exchanger as set forth in claim 19, including restricted passage means in the uppermost plate communicating with said inlet and outlet passages and surge tank to allow entrapped air in said passages to pass to the surge tank.

* * * * *

UNITED STATES PATENT OFFICE

CERTIFICATE OF CORRECTION

PATENT NO. : 4,011,905

DATED : March 15, 1977

INVENTOR(S) : GREGORY STEPHEN TRUSCOTT MILLARD

It is certified that error appears in the above-identified patent and that said Letters Patent are hereby corrected as shown below:

Column 5, line 37, after "therebetween" cancel "an" and insert -- and --.

Column 5, line 45 change "and outlet port" to -- an outlet port --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*